US007028412B2

(12) United States Patent
Boomershine

(10) Patent No.: US 7,028,412 B2
(45) Date of Patent: Apr. 18, 2006

(54) TEMPLATE FOR MEASURING, MARKING AND CUTTING OF CONSTRUCTION MATERIALS, AND METHOD OF USING SAME

(75) Inventor: Gary Lee Boomershine, San Mateo, CA (US)

(73) Assignee: The Amy Stocking Limited Partnership, Las Vegas, NV (US)

( * ) Notice: Subject to any disclaimer, the term of this patent is extended or adjusted under 35 U.S.C. 154(b) by 0 days.

(21) Appl. No.: 10/822,796

(22) Filed: Apr. 9, 2004

(65) Prior Publication Data

US 2005/0055837 A1 Mar. 17, 2005

Related U.S. Application Data

(60) Provisional application No. 60/502,642, filed on Sep. 12, 2003.

(51) Int. Cl.
*G01B 3/14* (2006.01)

(52) U.S. Cl. ..... 33/526; 33/566

(58) Field of Classification Search ..... 33/1 B, 33/526, 527, 562, 563, 566
See application file for complete search history.

(56) References Cited

U.S. PATENT DOCUMENTS

| | | | | |
|---|---|---|---|---|
| 2,466,919 | A * | 4/1949 | Sykes | 33/526 |
| 4,114,346 | A | 9/1978 | Kelly | |
| 4,659,409 | A | 4/1987 | Arafat | |
| 4,712,309 | A | 12/1987 | Kingston et al. | |
| 4,779,346 | A | 10/1988 | Schafer | |
| 4,827,625 | A | 5/1989 | Le Moal | |
| 4,899,455 | A | 2/1990 | Bovino et al. | |
| 5,038,490 | A | 8/1991 | Armstrong | |
| 5,181,326 | A | 1/1993 | Eberline | |
| 5,191,716 | A | 3/1993 | Anderson | |
| 5,263,260 | A | 11/1993 | Smith | |
| 5,361,508 | A | 11/1994 | Ruggiero | |
| 5,471,758 | A | 12/1995 | White, Sr. | |
| 5,577,328 | A * | 11/1996 | Kerry, Sr. | 33/563 |
| 5,701,680 | A | 12/1997 | Garcia et al. | |
| 5,768,793 | A | 6/1998 | Fields | |
| 5,922,157 | A | 7/1999 | Snider | |
| 6,112,424 | A | 9/2000 | Friend | |
| 6,115,926 | A | 9/2000 | Robell | |
| 6,195,904 | B1 | 3/2001 | Greer | |
| 6,269,595 | B1 | 8/2001 | Blubaugh et al. | |
| 6,412,185 | B1 | 7/2002 | Mills et al. | |
| 6,481,112 | B1 | 11/2002 | White | |
| 6,539,643 | B1 | 4/2003 | Gleeson | |
| 2003/0115767 | A1 * | 6/2003 | Wedekind et al. | 33/566 |
| 2004/0088870 | A1 * | 5/2004 | Schafer et al. | 33/1 B |

* cited by examiner

*Primary Examiner*—Christopher W. Fulton
(74) *Attorney, Agent, or Firm*—David M. Lafkas; Lafkas Patent LLC

(57) ABSTRACT

The invention relates to a template for determining the shape and size construction materials should be cut to substantially match an irregularly shaped area to be covered by the construction materials. The template is a single layer material having lines that permit snapping off parts of the template without a cutting instrument. The template also has pegs on periphery edges of the template to assist in positioning the template. The invention also relates to a method of installing construction materials into an irregularly shaped area with the template.

18 Claims, 7 Drawing Sheets

TEMPLATE FOR MEASURING, MARKING AND CUTTING OF CONSTRUCTION MATERIALS, AND METHOD OF USING SAME

CROSS-REFERENCE TO RELATED APPLICATIONS

This application for a patent claims priority to U.S. Patent Application Ser. No. 60/502,642 as filed Sep. 12, 2003.

BACKGROUND OF THE INVENTION

1. Field of the Invention

The invention relates generally to measuring devices, and more particularly to a measuring device for measuring, marking, and subsequently cutting material around shapes and sizes irregular from the original shape and size of the material.

2. Discussion of the Prior Art

Construction materials such as, for example, ceramic tiles, carpeting, countertops and flooring, typically are manufactured and commercially available in rectangular and/or square shapes. It is common practice in the construction industry, for example, when laying or installing such construction materials, to begin working from the one corner of the area to be covered by the construction materials and placing as many whole, i.e., uncut construction materials first and leaving all irregular shape areas, that is, for example, corners, periphery walls, angles curves, turns, and/or other obstructions such as pipes and vents, to be covered last. Then, after the uncut construction materials have been properly placed, construction materials are added adjacent to the construction materials in the irregular areas by precisely measuring, marking and cutting the construction materials to ensure a substantial match between the construction materials and the irregular shapes.

The process of properly measuring, marking and cutting of the construction materials to substantially match the irregular shapes of the area to be covered is often the most time consuming and difficult aspect of installing tile and/or other similar construction materials. If the construction material is cut to long, then the construction materials cannot be properly adjusted and may eventually warp, crack, or come loose, thus requiring further future time and expenses. Similarly, if the construction material is cut to short, the construction material may eventually work loose, likewise requiring addition future time and expenses. If the cut of the construction material does not substantially match the contours of the irregularly shaped area to be covered, defections can be easily seen by the eye unless covered with another material. When the construction material is tile, for example, grout may be used to fill the space between tiles and may or may not make the defection less noticeable. Nonetheless, measuring, marking and cutting tile is a very tedious and time consuming process and the most difficult part of installing many construction materials such as, for example, tile.

The most common practice to attempt to substantially match construction materials with irregular shapes is highly inefficient, inaccurate and costly. Typically, one measures, marks and cuts the construction material based on a simple visual inspection and guess work, sometimes employing elementary instruments such as a square, tape measure, ruler, and a pencil. Typically, the construction materials are cut improperly such that many mistakes develop such as the cut construction materials are too long, too short, or not substantially aligned with the other construction materials already installed. Thus, a significant amount of time and materials is wasted resulting in an increased cost in both labor and materials.

There are some devices currently available to assist in installing construction materials around irregular shapes; however, these devices are often complex and require multiple adjustments to a series of guides. Further, these devices are expensive to purchase and manufacture, and still require a substantial use of time.

Thus, what is needed is a simple and cost effective approach to measuring, marking and cutting construction materials to be installed having irregular shapes to substantially match around corners, periphery walls, or other obstructions such as, for example, pipes or vents.

SUMMARY OF THE INVENTION

The various exemplary embodiments of the present invention comprises a template for determining the shape and size construction materials should be cut to substantially match an irregularly shaped area to be covered by the construction materials, wherein the template comprises a single layer material comprising lines of weakness that permit snapping off parts of the template without a cutting instrument.

The various exemplary embodiments of the present invention further comprises a method of installing one or more construction materials into an irregularly shaped area to be covered by the construction materials, comprising discovering an irregularly shaped area to be covered by construction materials such that the irregularly shaped area is of a different shape than the construction materials, sizing one or more templates to be substantially similar in shape and size as the construction materials, comparing the one or more sized templates to the irregularly shaped area, shaping the one or more templates by removing sections such that the one or more templates are substantially similar in size and shape as the irregularly shaped area, placing the one or more shaped templates on top of the construction materials, marking the construction materials to be substantially similar in size and shape as the one or more shaped templates, removing the one or more shaped templates from the marked construction materials, removing one or more regions of the construction materials that is not substantially similar to the irregularly shaped area, and positioning the construction materials with the one or more regions removed in the irregularly shaped area.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION OF THE INVENTION

Figure 1:
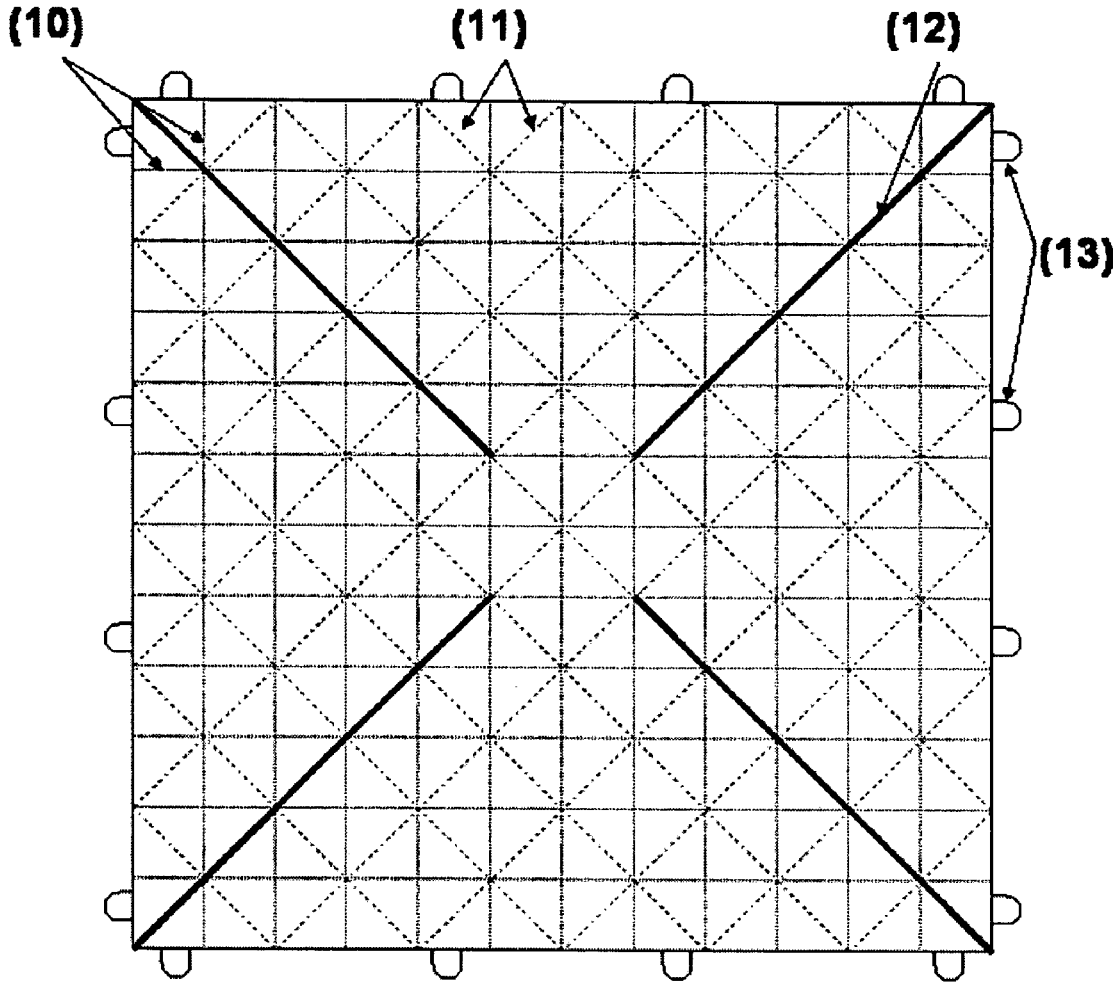
FIG. 1 is an illustration of a top view of an uncut template comprising lines of weakness along the horizontal, vertical and diagonal axes at regular intervals.

The exemplary embodiments of the present invention seeks to overcome the deficiencies of current methods of measuring, marking and cutting construction materials such as, for example, tiles, by providing a simple and cost effective approach.

The exemplary embodiments of the present invention comprises a template that is designed for a user to easily break away pieces of the template along one or more lines of weakness as to easily place the template into the area to be measured, wherein the area to be measured is irregular in shape. That is, the area to be measured is of a different size and/or shape as the construction material to be installed over the area. The area having an irregular shape often includes obstructions such as one or more walls, one or more corners, one or more edges, a doorway, exposed pipes, vents, etc. A user of the template according to the exemplary embodiments of the present invention removes small sections of the template along, for example, predetermined horizontal, vertical and/or diagonal lines of weakness to shape the template to substantially match the irregular shape. The user may then lay the shaped template where the construction material is to be installed.

In an exemplary embodiment, the template is comprised of a single layer. The single layer may be comprised of plastic, cardboard, paper, aluminum, styrene, and combinations thereof.

"Lines of weakness" as used herein comprises perforations, scores, partial or full cuts, and combinations thereof. The lines of weakness are preferably predetermined and allow for simple removal of undesired pieces from the template.

The lines of weakness may be along horizontal, vertical and diagonal axes of the template at regular intervals. For example, on a template having a width of twelve inches and a length of twelve inches, there may be, for example, eleven lines of weakness, each one inch apart, running along the horizontal axis, and eleven lines of weakness, each one inch apart, running along the vertical axis. Further, the template may comprise diagonal lines of weakness running from the corners of the template through the center of the template, in the example where the template is a square. There may be additional diagonal lines of weakness, that is, for example, lines at forty-five and one hundred thirty-five degree angles, running parallel to the diagonal lines of weakness running from the corners of the templates but at a predetermined distance apart, for example, one inch. In a preferred exemplary embodiment of the present invention, the template comprises horizontal, vertical and diagonal axes when the template is square or rectangular in shape.

In various exemplary embodiments, the diagonal lines of weakness will line up substantially with the horizontal and vertical lines of weakness. In this way, the template will comprise lines of weakness in the shapes of triangles and squares across the entire template that can be snapped off along any line of weakness.

It should be understood, however, that the template according to the exemplary embodiments of the present invention may comprise lines of weakness in fewer than the three axes noted above. Further, the template may comprise further lines of weakness such as, for example, circular or curved lines, based on the irregular shapes to be substantially matched to, or based on the shape of the template to be used according to the present invention. The template according to the present invention may be of any known geometrical shape and the distance between any lines of weakness of the template may be of any predetermined distance.

The template according to the various exemplary embodiments of the present invention may also comprise printed material. Preferably, the printed material is on a topside of the template. The printed material may comprise directions, numerical values, company names, logos, and the like.

The material comprising the template according to the exemplary embodiments of the present invention is preferably a thin breakable piece of plastic or other plastic-like material that when perforated, scored or partially cut can be simply snapped off in simple lines by one's fingers along the lines of weakness. The preferred material is thick enough to retain its shape and not break without pressure; however, when perforated, scored or partially cut along a line, the preferred material is easily snapped by applying pressure with ones fingers. The template should not break easily by fingers except on the lines of weakness. In an exemplary embodiment, the material comprising the template is selected from the group consisting of plastic, cardboard, paper, aluminum, styrene, and combinations thereof. In a preferred embodiment, the template is comprised of styrene.

The template according to exemplary embodiments of the present invention may further comprise of legs, also referred to as "pegs" on the outer edges of the template. The pegs are used as a guide for the distance between construction materials and other materials, for example, wherein the construction material is tile; the pegs serve as a guide for the distance between other tiles, i.e., the area where the tile grout is located.

In exemplary embodiments of the present invention, the pegs are set to match the spacing between tiles or other material being set at a predetermined distance, for example, one-eighth, one-third, one-quarter, or one-half of one inch. In a preferred exemplary embodiment of the present invention, the pegs will are on an outer periphery edge of the uncut template. Preferably, the pegs are at a distance substantially equidistant from each other, for example, about two to about four inches apart from one another.

In an exemplary embodiment of the present invention, the template may further comprise one or more additional layers or coatings on the underside of the template. The one or more additional layers may be a wax or removable thin plastic sheet to repel moisture, or mastic adhesives already present in the irregular shape meant to adhere to the construction material. The one or more additional layers may be an adhesive that allows the template to hold more accurately to the construction material to be shaped, but when the template is removed, the adhesive does not leave any marks or residue.

The process of installing construction materials such as, for example, tiles, pieces of carpeting, marble, granite, wallpaper, and the like, typically begins by installing construction materials from a corner or similar area by installing and/or placing uncut construction materials and working outward in a predetermined pattern or random order.

Typically, while installing the construction materials, irregular shapes, that is, for example, shapes of different shapes or sizes as the construction materials, develop in the area to be covered by the construction materials. The irregular shapes may be due to barriers such as walls, corners, exposed pipes, vents, and the like. However, since the construction materials are not the same size or shape as the irregular shape of the area to be covered, the construction materials must be shaped to substantially match the irregular shape.

In the exemplary embodiments of the present invention, when an irregular shape is found, the user places a template of the same size and shape as the construction material and compares the template to the irregular shape. The user then removes parts of the template along lines of weakness such that the template is shaped and substantially matches the irregular shape. The template need not be an exact match to the irregular shape; however, the template with removed parts may be smaller than the irregular shape. In a preferred embodiment, the user places the template in the irregular shape to better ensure that the shaped template substantially matches the irregular shape. Once the template is in the irregular shape and it is determined that it substantially matches the irregular shape, a marking material such as, for example, tape or other similar sticking-like material, is placed along the line to be eventually marked and cut on the construction material. The marking material captures a line substantially similar to the line and/or shape to be measured, marked and cut in order to substantially match the irregular shape. It is preferred that the marking material is wide enough to stick onto the template. The shaped and marked template is then removed from the irregular shape and set on top of the construction material to be shaped to substantially match the irregular shape. A marking instrument such as, for example, a pencil, a marker, one or more pieces of tape, and the like, is used to indicate on the construction material, based on the marked lines of the template, where the construction material is to be cut in order to substantially match the irregular shape. The template is then removed from on top of the now marked construction material such that the construction material can be cut along the marked line. A template can be reused one or more times to measure similar and or smaller irregular shapes.

In preferred embodiments, when the user removes parts of the templates along the lines of weakness, the user snaps off the parts using only one's hands and/or fingers. It is preferred that the template need not be cut using a cutting instrument.

In another preferred embodiment, when the template is placed on top of the construction material, the pegs of the template may be used as a guide to better ensure a substantial alignment on top of the construction material. The pegs can also be easily snapped off by the user's fingers as needed.

In exemplary embodiments of the present invention, the size, dimension, layout, length of pegs, lines of weakness shall and complete cuts are not be limited to size, shape or form, but instead available in any standard form used or sold commercially (e.g. tile square, tile bullnoze, tile quarter round, etc.).

FIG. 1 shows an example of an uncut template having a square shape having the same perimeter dimensions as, for example, an 11 13/16 inches by 11 13/16 inches ceramic tile. The horizontal and vertical lines of weakness 10 are equidistant from one another. The diagonal lines of weakness 11 at forty-five degree and one hundred thirty-five degree angles are equidistant from each other and connect to both horizontal and vertical lines of weakness 10. A complete cut 12 is present at each corner of the template at forty-five degree and one hundred thirty-five degree angles approximately 40 percent across the template. Such complete cuts 12 allow for more easily snapping off or breaking off of the inner squares and triangles by applying pressure by ones fingers. Pegs 13 protrude from the perimeter of the template to resemble tile grout space or space between objects.

Figure 2:
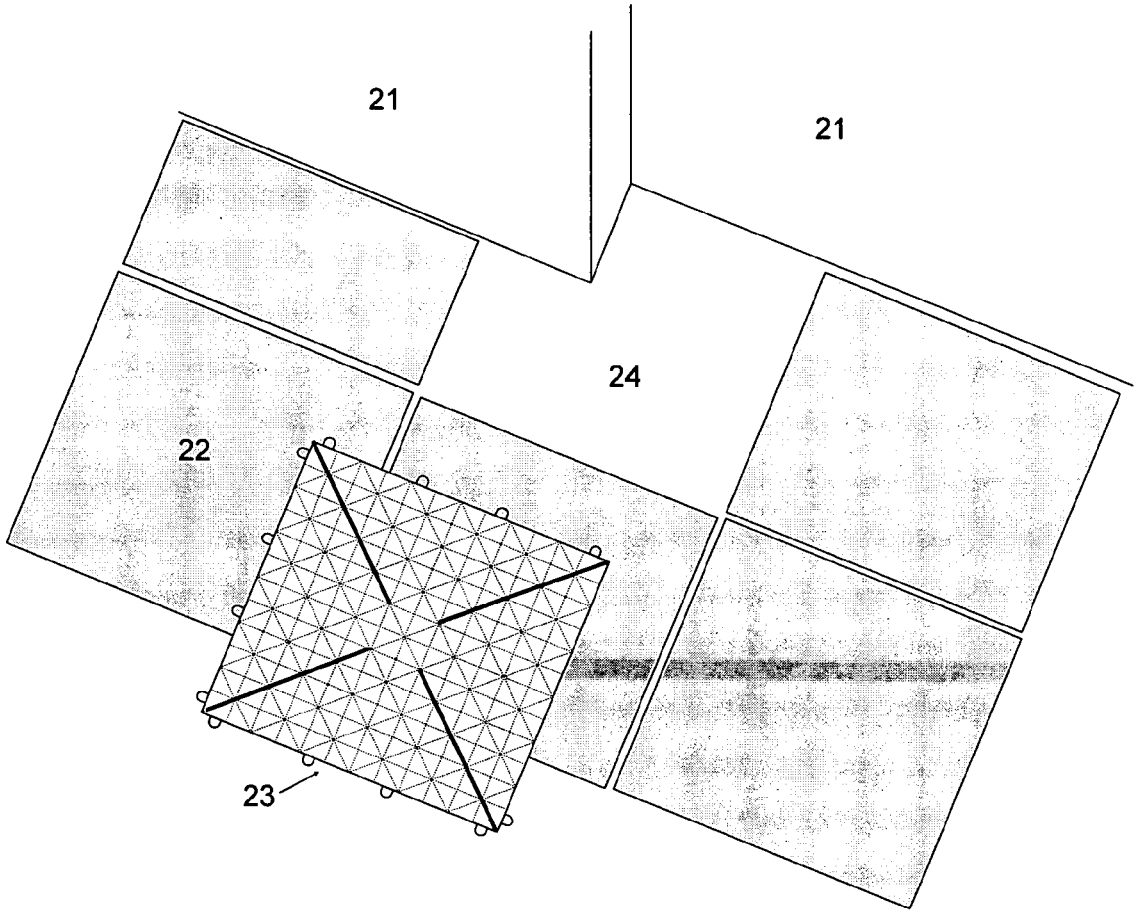
FIG. 2 is an illustration of a top view of an area to be covered by construction materials, such as, for example, tiles, wherein an irregular shape is present in the area, for example, a corner, requiring measuring, marking and cutting of the construction material to ensure a substantial match to the irregular shape.

FIG. 2 shows a depiction of an irregular shape 24 developed between the obstructions of already installed construction materials 22 and walls 21. The template 23 is uncut.

Figure 3:
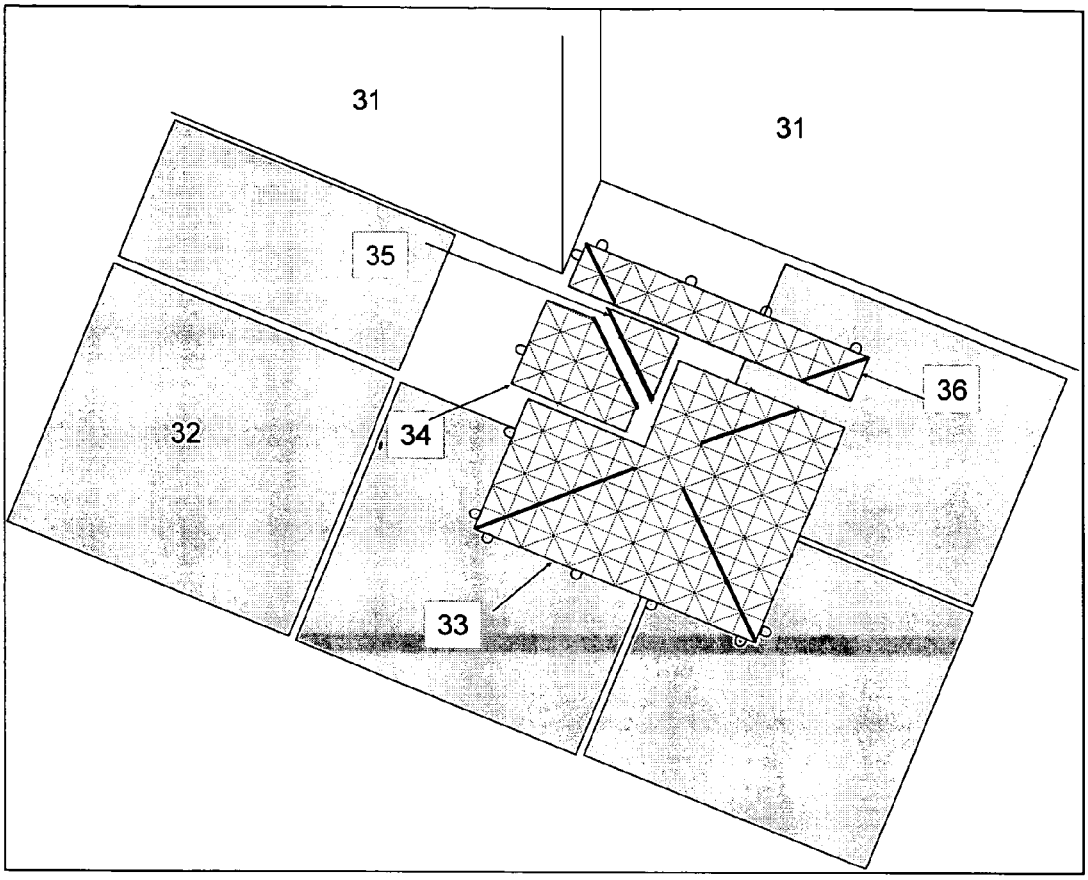
FIG. 3 is an illustration of the irregular shape wherein a template according to the exemplary embodiments of the present invention is shaped to substantially match the irregular shape by snapping off parts of the template that do not substantially match the irregular shape.

FIG. 3 shows a top view of an area in a room having an irregular shape 37 and shaped template 33, wherein template parts 34, 35 and 36 have been removed from the template by snapping off the template parts appropriately to allow for easy placement and substantial matching of the shaped template into the irregular shape 37. It is not critical that the shaped template 33 have a perfect or exact fit into the irregular shape.

Figure 4:
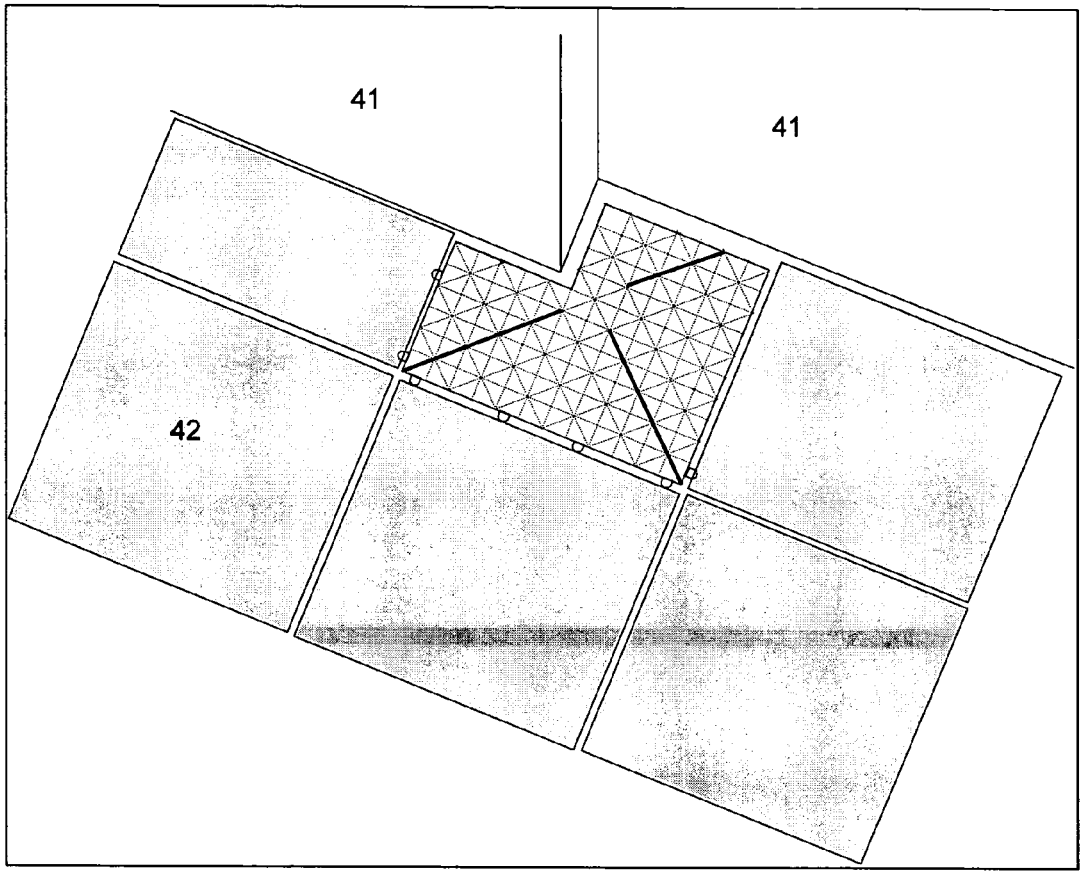
FIG. 4 is an illustration of a top view of the irregular shape in the area to be covered, wherein the template according to the exemplary embodiments of the present invention is shaped to substantially match the irregular shape.

In FIG. 4, the shaped template 43 is placed in the irregular shape.

Figure 5:
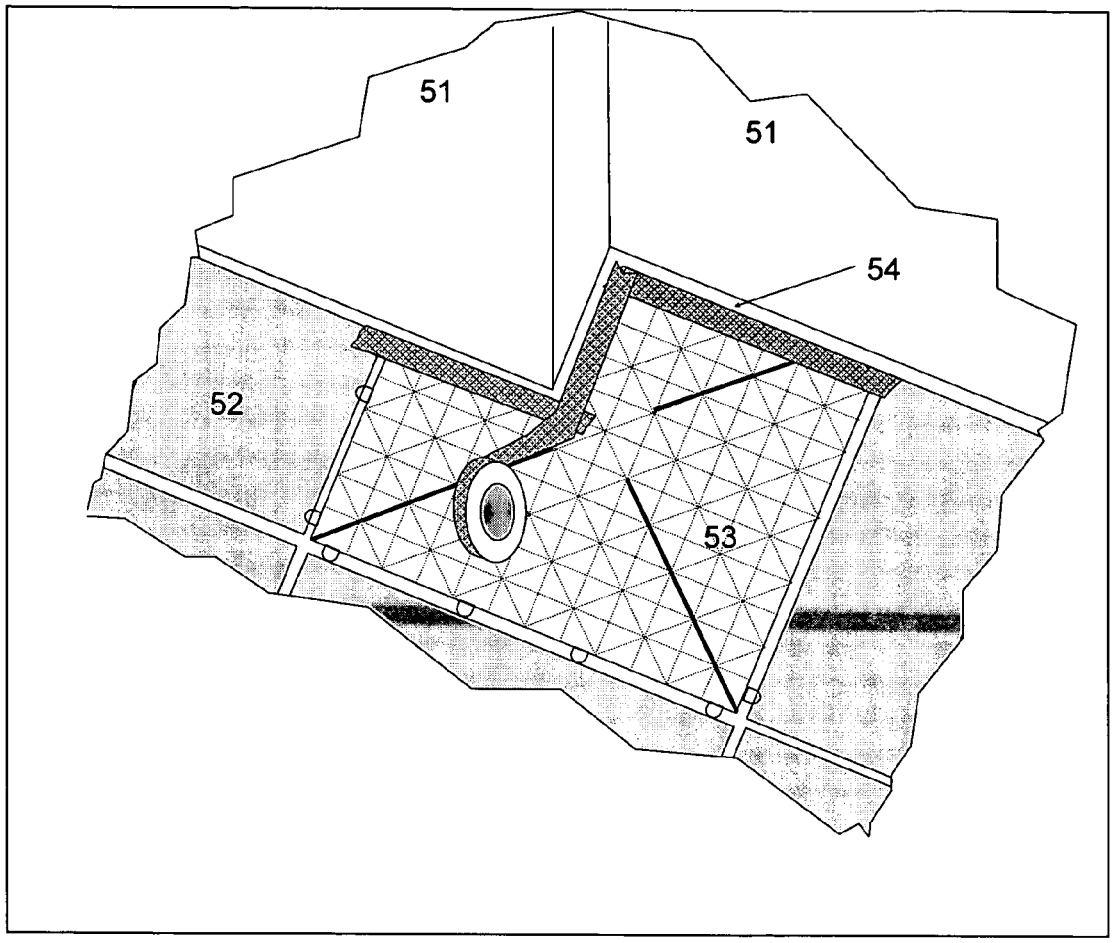
FIG. 5 is an illustration of a top view of the irregular shape in the area to be covered having the template according to the present invention fit in the irregular shape and having a marking material, such as, for example, tape placed along edges or shapes where the marking and cutting are needed.

FIG. 5 shows the shaped template 53 placed in the irregular shape with masking tape 54 is laid along a cut edge 55 of the shaped template 53 to set the lines to cut on the construction material. The masking tape should stick to the template and will remain stuck to the template when removed away from the sample area.

Figure 6:
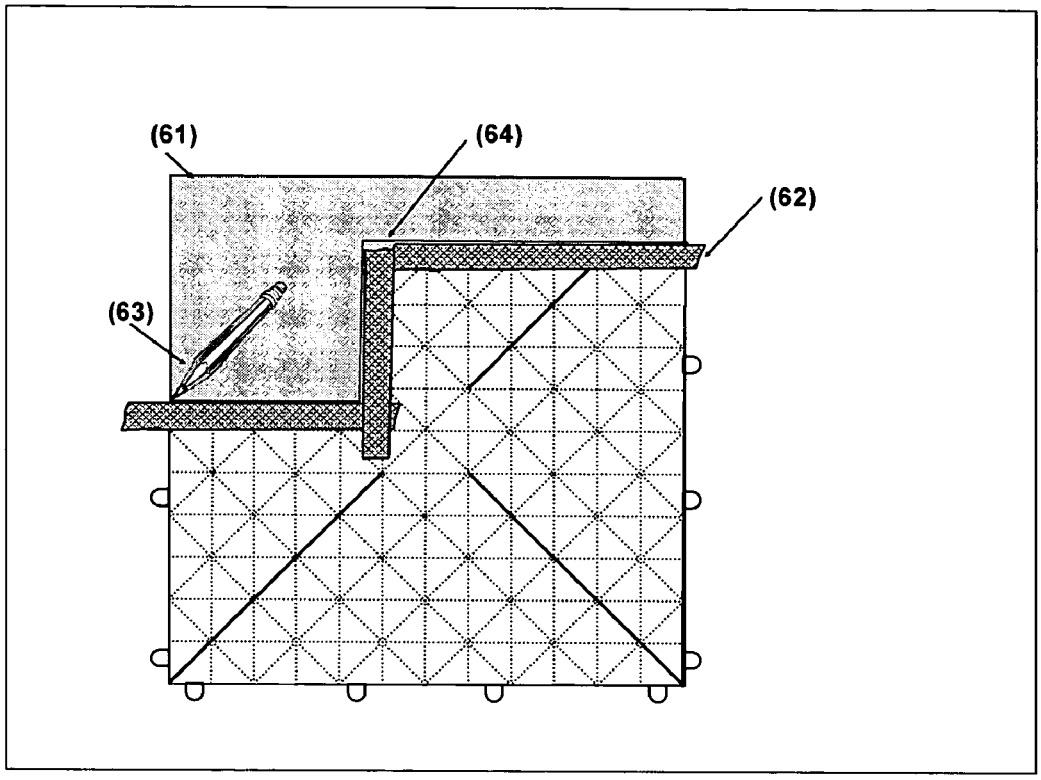
FIG. 6 depicts the template according to the present invention having been shaped to substantially match the irregular shape and marked with a marking material being on top of an uncut construction material to be marked and cut.

FIG. 6 shows the shaped template 63 placed on top of a construction material, here an uncut tile 61, wherein the un-removed edges 65 of shaped template edges are aligned to the uncut tile 61 to better ensure that the masking tape 62 aligns properly on the uncut tile 61. A seal is then made between the shaped template 63, masking tape 62 and the uncut tile 61. The masking tape 62 identifies the lines 64 to be marked on the uncut tile 61. A pencil 66 or drawing instrument is used to mark the lines on the tile to be cut. In some cases, an angle or rule can be used to complete a line if the masking tape does not completely capture the entire line.

Figure 7:
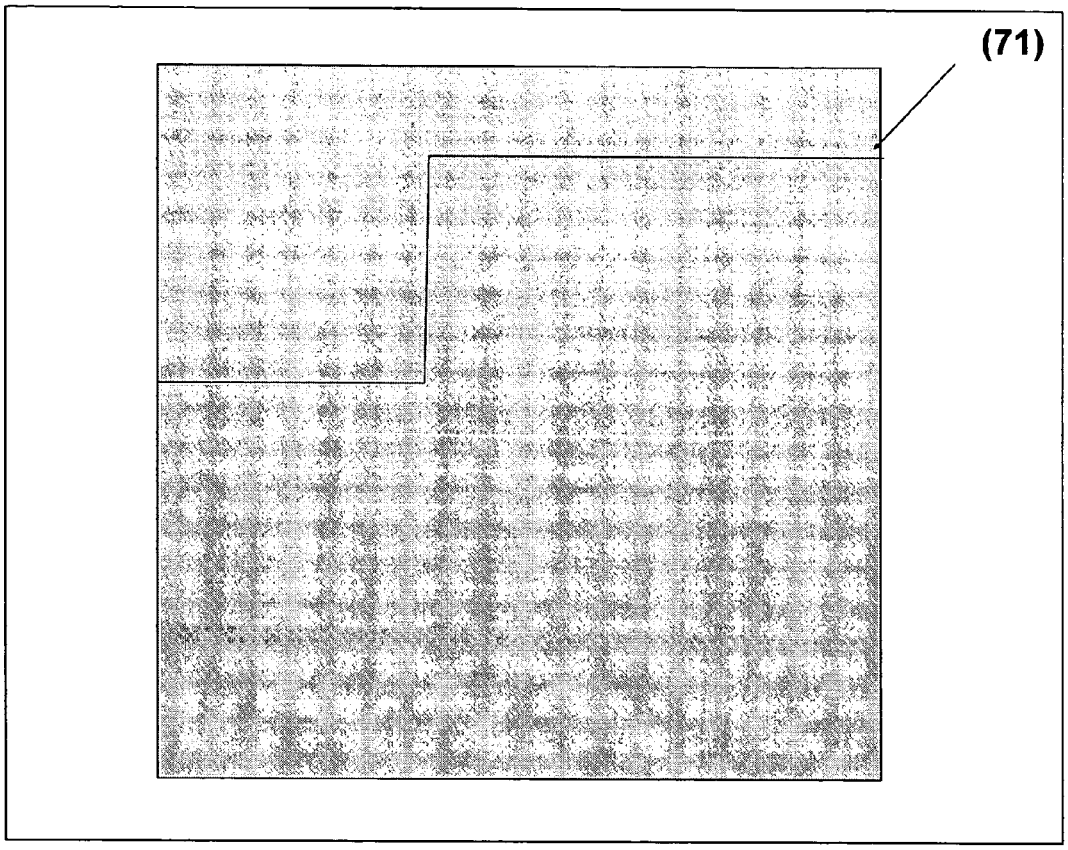
FIG. 7 depicts the construction material to be cut having the final marks identifying where the construction material is to be cut in order to substantially match the irregular shape.

FIG. 7 depicts the construction material to be cut having the final marks 71 identifying where the construction material is to be cut in order to substantially match the irregular shape. The construction material is thus ready to be cut using any of a variety of cutting methods based on the type of construction material, and is readily known in the relevant fields.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A template for determining the shape and size construction materials should be cut to substantially match an irregularly shaped area to be covered by the construction materials, wherein the template is reusable and comprises:

a single layer material comprising one or more lines of weakness that permit snapping off parts of the template without a cutting instrument; and one or more cuts through the single layer material beginning at corners of the template towards the center of the template such that one or more cuts extend up to about forty percent across the template.

2. The template according to claim 1, further comprising one or more pegs on periphery edges of the template.

3. The template according to claim 1, wherein the single layer material is selected from the group consisting of plastic, cardboard, paper, styrene, and aluminum.

4. The template according to claim 1, wherein the single layer material is styrene.

5. The template according to claim 1, wherein the one or more lines of weakness are horizontal and parallel to each other at a predetermined distance.

6. The template according to claim 1, wherein the one or more lines of weakness are vertical and parallel to each other at a predetermined distance.

7. The template according to claim 1, wherein the one or more lines of weakness are diagonal and parallel to each other at a predetermined distance.

8. The template according to claim 1, wherein the one or more lines of weakness comprise perforations, scores, or combinations thereof.

9. The template according to claim 1, wherein the template further comprise one or more protective layers on a backside of the template.

10. The template according to claim 9, wherein the one o more protective layers is a wax.

11. The template according to claim 9, wherein the one or more protective layers is a removable thin plastic sheet.

12. The template according to claim 1, wherein the template further comprises an adhesive on a backside of the template.

13. The template according to claim 1, wherein the template further comprises printed material on a topside of the template.

14. A method of installing one or more construction materials into an irregularly shaped area to be covered by the construction materials, comprising discovering an irregularly shaped area to be covered by construction materials such that the irregularly shaped area is of a different shape than the construction materials;

sizing one or more templates to be substantially similar in shape and size as the construction materials, wherein the template is reusable and comprises a single layer material comprising one or more lines of weakness that permit snapping off parts of the template without a cutting instrument and one or more cuts through the single layer material beginning at corners of the template towards the center of the template such that the cut extends up to about forty percent across the template;

comparing the one or more sized templates to the irregularly shaped area;

shaping the one or more templates by removing sections such that the one or more templates are substantially similar in size and shape as the irregularly shaped area;

placing the one or more shaped templates on top of the construction materials;

marking the construction materials to be substantially similar in size and shape as the one or more shaped templates;

removing the one or more sized templates from the marked construction materials;

removing one or more regions of the construction materials that is not substantially similar to the irregularly shaped area; and positioning the construction materials with the one or more regions removed in the irregularly shaped area.

15. The method according to claim 14, wherein the template comprises one or more pegs on periphery edges of the template.

16. The method according to claim 14, further comprising placing the one or more shaped template into the irregularly shaped area before placing the one or more shaped templates on top of the construction materials.

17. The method according to claim 14, further comprising marking the one or more shaped template with tape along edges where sections of the one or more templates have been removed before placing the one or more shaped templates on top of the construction materials.

18. The method according to claim 14, wherein when removing sections of the one or more templates such that the one or more templates are substantially similar in size and shape as the irregularly shaped area, the sections are removed by being snapped off with a user's hands.

* * * * *